US006021852A

United States Patent [19]

Barnett et al.

[11] Patent Number: 6,021,852

[45] Date of Patent: Feb. 8, 2000

[54] SELF-CONTAINED, REPLACEABLE FIRE EXTINGUISHING TREE ORNAMENT

[76] Inventors: Louis S. Barnett; Richard M. High, both of 24294 Fiji Dr., Moreno Valley, Calif. 92551-6937

[21] Appl. No.: 09/065,183

[22] Filed: Apr. 23, 1998

[51] Int. Cl.[7] ..... A62C 37/14

[52] U.S. Cl. ..... 169/58

[58] Field of Search ..... 169/71, 26, 56, 169/58, 60; 340/628

[56] References Cited

U.S. PATENT DOCUMENTS

| | | | |
|---|---|---|---|
| 3,132,695 | 5/1964 | Peltier | 169/26 |
| 3,171,493 | 3/1965 | Barr | 169/26 |
| 4,709,763 | 12/1987 | Jessick | 169/26 |
| 4,896,728 | 1/1990 | Wolff et al. | 169/26 |
| 5,040,610 | 8/1991 | Blanchong | 169/56 |
| 5,396,221 | 3/1995 | Bridges | 340/628 |

*Primary Examiner*—Andres Kashnikow
*Assistant Examiner*—Davis Hwu

[57] ABSTRACT

A fire extinguishing tree ornament is provided including a containment bulb for being hung on a tree. The containment bulb has contained therein a fire extinguishing material. Also included is a piercing mechanism for piercing the bulb upon the receipt of an activation signal. A smoke detector is adapted for transmitting the activation signal to the piercing means upon the detection of a fire.

7 Claims, 3 Drawing Sheets

SELF-CONTAINED, REPLACEABLE FIRE EXTINGUISHING TREE ORNAMENT

BACKGROUND OF THE INVENTION

1. Field of the Invention

The present invention relates to fire extinguishers for Christmas trees and more particularly pertains to a new self-contained, replaceable fire extinguishing tree ornament for extinguishing a fire on a Christmas tree.

2. Description of the Prior Art

The use of fire extinguishers for Christmas trees is known in the prior art. More specifically, fire extinguishers for Christmas trees heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire extinguishers for Christmas trees include U.S. Pat. No. 4,830,114; U.S. Pat. No. 3,171,493; U.S. Pat. No. 5,396,221; U.S. Pat. No. 5,031,702; U.S. Pat. No. 5,018,586; and U.S. Pat. No. 2,522,020.

In these respects, the self-contained, replaceable fire extinguishing tree ornament according to the present invention substantially departs from the conventional concepts and designs of the prior art, and in so doing provides an apparatus primarily developed for the purpose of extinguishing a fire on a Christmas tree.

SUMMARY OF THE INVENTION

In view of the foregoing disadvantages inherent in the known types of fire extinguishers for Christmas trees now present in the prior art, the present invention provides a new self-contained, replaceable fire extinguishing tree ornament construction wherein the same can be utilized for extinguishing a fire on a Christmas tree.

The general purpose of the present invention, which will be described subsequently in greater detail, is to provide a new self-contained, replaceable fire extinguishing tree ornament apparatus and method which has many of the advantages of the fire extinguishers for Christmas trees mentioned heretofore and many novel features that result in a new self-contained, replaceable fire extinguishing tree ornament which is not anticipated, rendered obvious, suggested, or even implied by any of the prior art fire extinguishers for Christmas trees, either alone or in any combination thereof.

To attain this, the present invention generally comprises a containment bulb constructed from a heat resistant material. The bulb includes an upper extent having a spherical configuration and a lower extent having a cylindrical configuration. As shown in the Figures, the lower extent is integrally coupled to the upper extent. For allowing the present invention to be hung on a tree, the upper extent preferably has an annular hanger in integrally coupled to an apex thereof. For reasons that will soon become apparent, the lower extent of the bulb has a sleeve mounted thereon. As shown in FIG. 4, an outer surface of the sleeve is equipped with a plurality of threaded grooves formed therein. Further, an open bottom of the sleeve is adapted for exposing a bottom face of the lower extent of the bulb. It should be noted that the bulb includes a predetermined amount of pressurized fire extinguishing material therein. Next provided is a housing with a cylindrical configuration constructed from a material similar to that from which the bulb is constructed. The housing has an open top having a plurality of threaded grooves formed in an interior surface thereof for screwably receiving the sleeve of the containment bulb. When coupled, an axis of the housing intersects a center of the bulb. Mounted within the housing is a divider for defining an upper portion and a lower portion, as shown in FIG. 4. An open bottom of the housing has a plurality of threaded grooves formed in an interior surface thereof for screwably receiving a cap. A plurality of radially extending outlet bores are formed in the upper portion of the housing for reasons that will soon become apparent. Such outlet bores reside in a common plane and circumnavigate a selected portion of the housing. With reference to FIG. 3, a piercing means is provided including a lever pivotally coupled at an intermediate extent thereof within the upper portion of the housing. A first end of the lever is equipped with a sharpened tip mounted thereon for piercing the bottom face of the bulb when raised. An actuator member has a top end pivotally coupled to a second end of the lever and depends downwardly therefrom. Connected to a bottom end of the actuator member is an actuation means for retracting the same upon the receipt of an activation signal. As such, the sharpened tip is elevated so as to allow the expulsion of the fire extinguishing material from the outlet bores. Finally, a smoke detector is mounted within the lower portion of the housing adjacent to a plurality of breathing apertures formed in the lower portion of the housing. The smoke detector is further connected to the actuation means. During use, the smoke detector serves for transmitting the activation signal thereto only upon the detection of smoke through the breathing apertures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new self-contained, replaceable fire extinguishing tree ornament apparatus and method which has many of the advantages of the fire extinguishers for Christmas trees mentioned heretofore and many novel features that result in a new self-contained, replaceable fire extinguishing tree ornament which is not anticipated, rendered obvious, suggested, or even implied by any of the prior art fire extinguishers for Christmas trees, either alone or in any combination thereof.

It is another object of the present invention to provide a new self-contained, replaceable fire extinguishing tree ornament which may be easily and efficiently manufactured and marketed.

It is a further object of the present invention to provide a new self-contained, replaceable fire extinguishing tree ornament which is of a durable and reliable construction.

An even further object of the present invention is to provide a new self-contained, replaceable fire extinguishing tree ornament which is susceptible of a low cost of manufacture with regard to both materials and labor, and which accordingly is then susceptible of low prices of sale to the consuming public, thereby making such self-contained, replaceable fire extinguishing tree ornament economically available to the buying public.

Still yet another object of the present invention is to provide a new self-contained, replaceable fire extinguishing tree ornament which provides in the apparatuses and methods of the prior art some of the advantages thereof, while simultaneously overcoming some of the disadvantages normally associated therewith.

Still another object of the present invention is to provide a new self-contained, replaceable fire extinguishing tree ornament for extinguishing a fire on a Christmas tree.

Even still another object of the present invention is to provide a new self-contained, replaceable fire extinguishing tree ornament that includes a containment bulb for being hung on a tree. The containment bulb has contained therein a fire extinguishing material. Also included is a piercing mechanism for piercing the bulb upon the receipt of an activation signal. A smoke detector is adapted for transmitting the activation signal to the piercing means upon the detection of a fire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
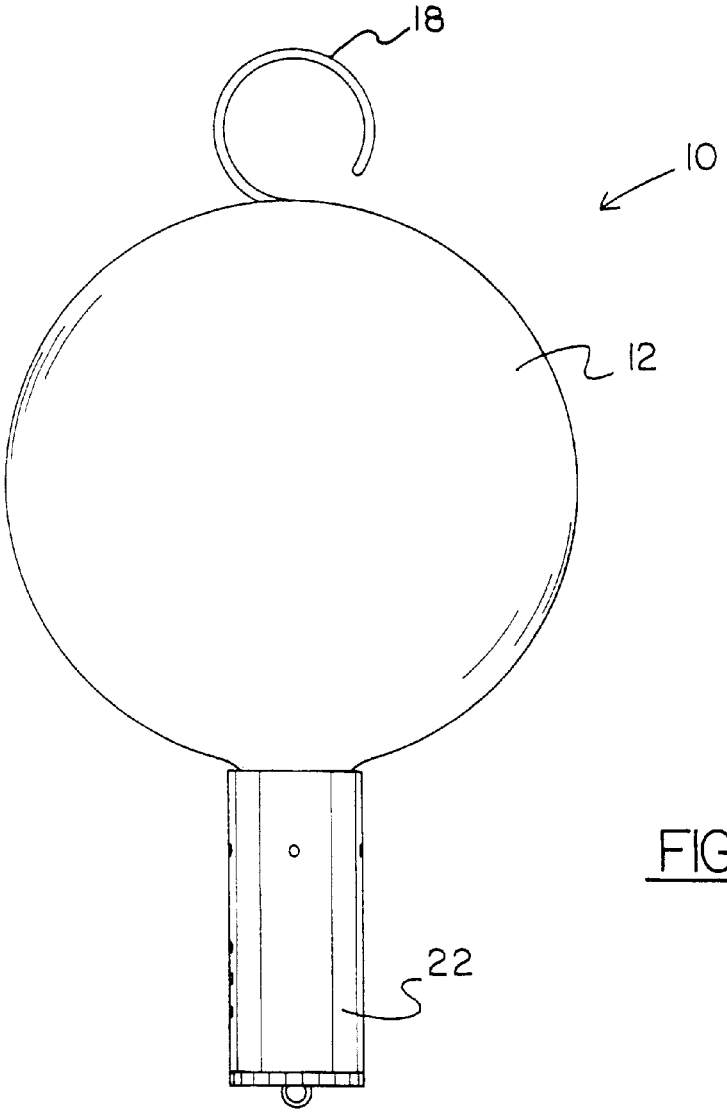
FIG. 1 is a side view of a new self-contained, replaceable fire extinguishing tree ornament according to the present invention.
Figure 2:
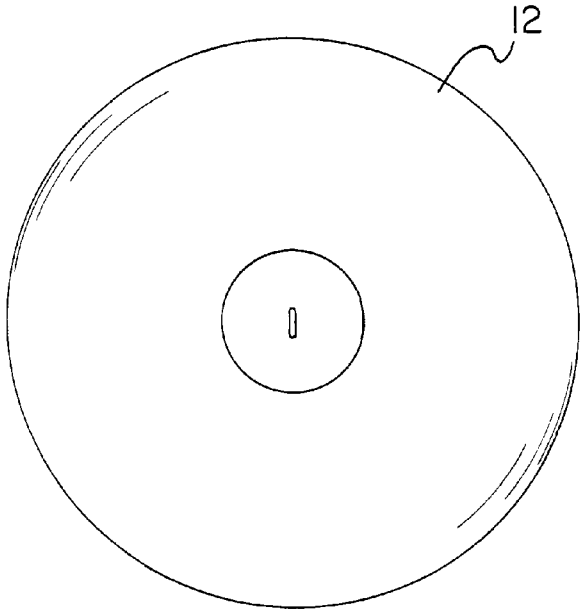
FIG. 2 is a top view of the present invention.

With reference now to the drawings, and in particular to FIGS. 1 through 4 thereof, a new self-contained, replaceable fire extinguishing tree ornament embodying the principles and concepts of the present invention and generally designated by the reference numeral 10 will be described.

The present invention, designated as numeral 10, includes a containment bulb 12 constructed from a heat resistant material having any one of various colors. The bulb includes an upper extent 14 having a spherical configuration and a lower extent 16 having a cylindrical configuration. As shown in the Figures, the lower extent is integrally coupled to the upper extent. For allowing the present invention to be hung on a tree, the upper extent preferably has an annular hanger 18 integrally coupled to an apex thereof. It is imperative that the hanger be connected to the bulb with the heat resistant material.

Figure 4:
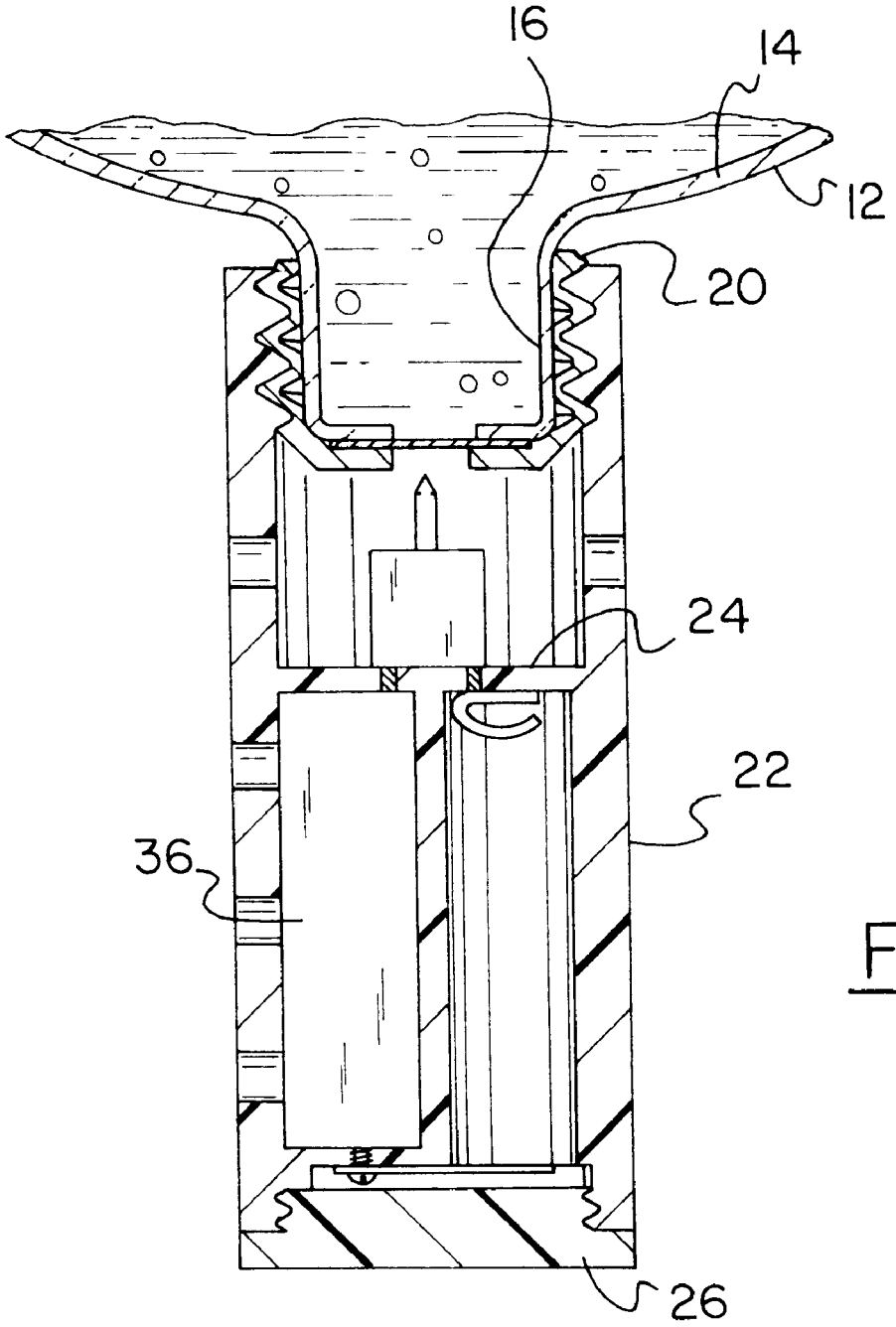
FIG. 4 is a side cross-sectional view of the present invention showing the interconnection between the bulb and housing and further an alternate embodiment of the piercing means.

For reasons that will soon become apparent, the lower extent of the bulb has a sleeve 20 mounted thereon. As shown in FIG. 4, an outer surface of the sleeve is equipped with a plurality of threaded grooves formed therein. Further, an open bottom of the sleeve is adapted for exposing a bottom face of the lower extent of the bulb. In the preferred embodiment, the bottom face of the lower extent of the bulb is formed of a layer of material having a thickness less than that of the remaining bulb and further comprising aluminum. It should be noted that the bulb includes a predetermined amount of pressurized fire extinguishing material therein.

Next provided is a housing 22 with a cylindrical configuration constructed from a material similar to that from which the bulb is constructed. As shown in FIG. 1, a length of the housing is between a radius and a diameter of the bulb. The housing has an open top with a plurality of threaded grooves formed in an interior surface thereof for screwably receiving the sleeve of the bulb. When coupled, an axis of the housing intersects a center of the bulb. Mounted within the housing is a divider 24 for defining an upper portion and a lower portion, as shown in FIG. 4.

An open bottom of the housing has a plurality of threaded grooves formed in an interior surface thereof for screwably receiving a cap 26. A plurality of radially extending outlet bores are formed in the upper portion of the housing for reasons that will soon become apparent. Such outlet bores reside in a common plane and circumnavigate a selected portion of the housing. Preferably, the present invention includes a plurality of devices each with outlet bores that span 45, 90, & 180 degrees of a circumference of the housing.

Figure 3:
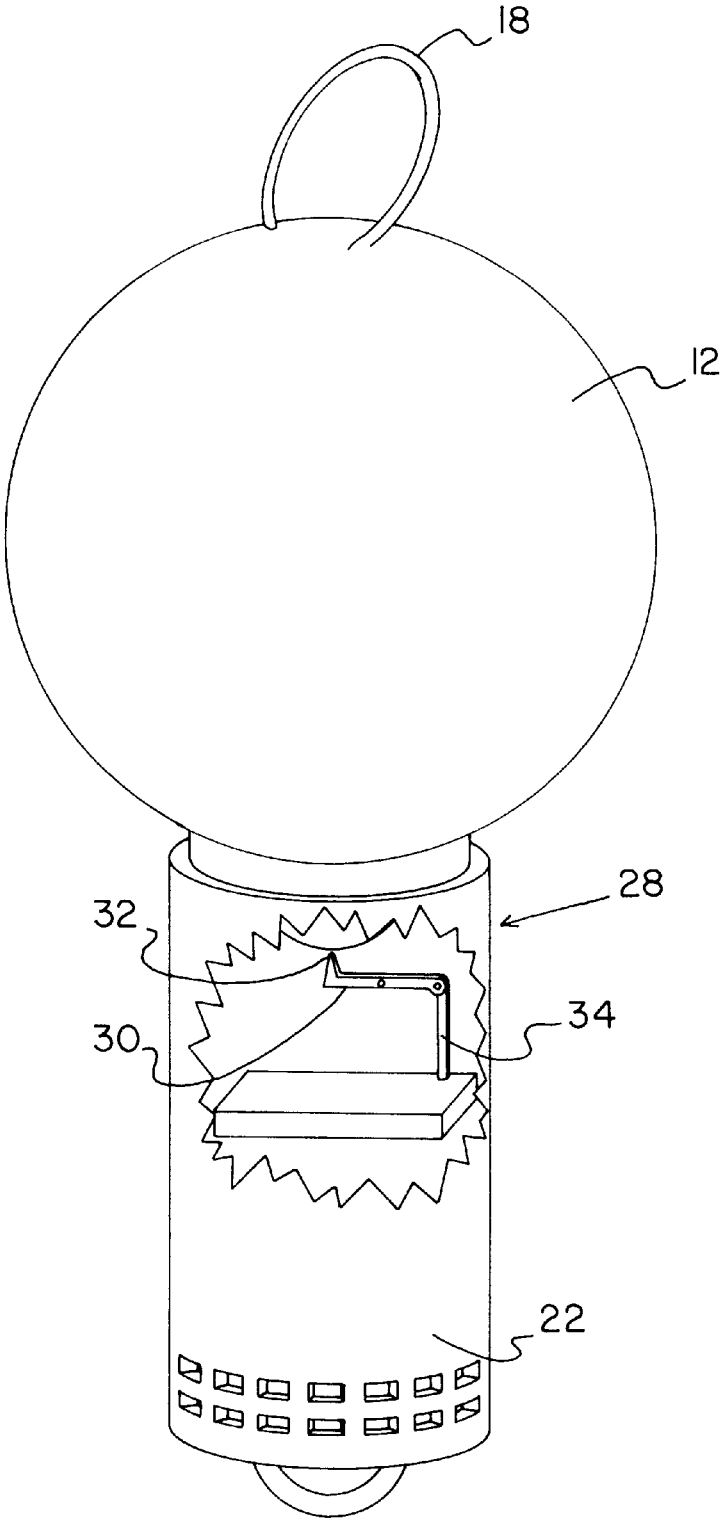
FIG. 3 is a side sectional view of the present invention showing the piercing means thereof.

With reference to FIG. 3, a piercing means 28 is provided including a lever 30 pivotally coupled at an intermediate extent thereof within the upper portion of the housing. A first end of the lever is equipped with a pyramid-shaped sharpened tip 32 mounted thereon for piercing the bottom face of the bulb when raised. A rigid or chain-like actuator member 34 has a top end pivotally coupled to a second end of the lever and depends downwardly therefrom. Connected to a bottom end of the actuator member is an actuation means for retracting the actuator member upon the receipt of an activation signal. Such actuation means may take the form of a solenoid or motor. With an alternate form of the piercing means, a simple solenoid may be employed, as shown in FIG. 4. When the actuation means is in receipt of the activation signal, the sharpened tip is elevated to allow the expulsion of the fire extinguishing material from the outlet bores.

Finally, a smoke detector 36 is mounted within the lower portion of the housing adjacent to a plurality of breathing apertures formed in the lower portion of the housing. The smoke detector is further connected to the actuation means. During use, the smoke detector serves for transmitting the activation signal to the actuation means only upon the detection of smoke through the breathing apertures. To power the smoke detector, a battery is preferably situated adjacent thereto in the lower portion of the housing. It should be noted that the bulb may be readily replaced after use by simply removing the same.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A self-contained, replaceable fire extinguishing tree ornament comprising, in combination:

a containment bulb constructed from a heat resistant material and including an upper extent having a spherical configuration and a lower extent having a cylindrical configuration integrally coupled to the upper extent, the upper extent having an annular hanger integrally coupled to an apex thereof for being hung on a tree, the lower extent having a sleeve mounted thereon with a plurality of threaded grooves formed therein and an open bottom for exposing a bottom face of the lower extent of the bulb, wherein the bulb includes a predetermined amount of pressurized fire extinguishing material therein;

a housing with a cylindrical configuration constructed from a material similar to that from which the bulb is constructed, the housing having an open top having a plurality of threaded grooves formed in an interior surface thereof for screwably receiving the sleeve of the containment bulb whereby the bulb is releasably coupled thereto such that an axis of the housing intersects a center of the bulb, a divider mounted within the housing for defining an upper portion and a lower portion, an open bottom with a plurality of threaded grooves formed in an interior surface thereof for screwably receiving a cap, and a plurality of radially extending outlet bores formed in the upper portion of the housing, the outlet bores residing in a common plane and circumnavigating a selected portion of the housing;

piercing means including a lever pivotally coupled at an intermediate extent thereof within the upper portion of the housing and having a first end with a sharpened tip mounted thereon for piercing the bottom face of the bulb when raised, an actuator member having a top end pivotally coupled to a second end of the lever and depending downwardly therefrom, and an actuation means connected to a bottom end of the actuator member for retracting the same upon the receipt of an activation signal, thereby elevating the sharpened tip so as to allow the expulsion of the fire extinguishing material from the outlet bores; and a smoke detector mounted within the lower portion of the housing adjacent to a plurality of breathing apertures formed in the lower portion of the housing, the smoke detector connected to the actuation means for transmitting the activation signal thereto only upon the detection of smoke through the breathing apertures.

2. A fire extinguishing tree ornament comprising:

containment means for being hung on a tree, the containment means having contained therein a fire extinguishing material;

piercing means for piercing the bulb upon the receipt of an activation signal;

fire detection means for transmitting the activation signal to the piercing means upon the detection of a fire; and a housing being removably coupled to the containment means, a plurality of radially extending outlet bores formed in an upper portion of the housing for dispersing the fire extinguishing material upon the bulb being pierced, the outlet bores residing in a common plane and circumnavigating a selected portion of the housing.

3. A fire extinguishing tree ornament as set forth in claim 2 wherein the containment means has a hanger loop mounted thereon for being hung on a tree.

4. A fire extinguishing tree ornament as set forth in claim 2 wherein the containment means takes the form of a bulb.

5. A fire extinguishing tree ornament as set forth in claim 2 wherein the piercing means includes a lever with a sharpened point.

6. A fire extinguishing tree ornament as set forth in claim 2 wherein the fire detection means includes a smoke detector.

7. A fire extinguishing tree ornament as set forth in claim 2 wherein the piercing means and fire detection means are situated within the housing coupled to the containment means.

* * * * *